US011619073B2

(12) United States Patent
Piccoli et al.

(10) Patent No.: US 11,619,073 B2
(45) Date of Patent: Apr. 4, 2023

(54) LOCKING SLED SECURITY DEVICE

(71) Applicant: CHECKPOINT SYSTEMS, INC., Thorofare, NJ (US)

(72) Inventors: Anthony F. Piccoli, West Deptford, NJ (US); Irene Ferández Camín, Barcelona (ES)

(73) Assignee: CHECKPOINT SYSTEMS, INC., Thorofare, NJ (US)

( * ) Notice: Subject to any disclaimer, the term of this patent is extended or adjusted under 35 U.S.C. 154(b) by 543 days.

(21) Appl. No.: 16/632,928

(22) PCT Filed: Jul. 27, 2018

(86) PCT No.: PCT/US2018/044099

§ 371 (c)(1),
(2) Date: Jan. 22, 2020

(87) PCT Pub. No.: WO2019/023582

PCT Pub. Date: Jan. 31, 2019

(65) Prior Publication Data

US 2020/0157854 A1 May 21, 2020

Related U.S. Application Data

(60) Provisional application No. 62/537,995, filed on Jul. 28, 2017.

(51) Int. Cl.

| | |
|---|---|
| ***E05B 73/00*** | (2006.01) |
| ***B65D 39/00*** | (2006.01) |
| ***B65D 51/24*** | (2006.01) |
| ***B65D 55/14*** | (2006.01) |

(52) U.S. Cl.
CPC ..... *E05B 73/0041* (2013.01); *B65D 39/0052* (2013.01); *B65D 51/248* (2013.01); *B65D 55/14* (2013.01); *E05B 73/0052* (2013.01)

(58) Field of Classification Search
CPC ..... E05B 73/0041; E05B 73/0052; E05B 15/1607; B65D 39/0052; B65D 51/248; B65D 55/14; B65D 2203/10
USPC ..... 215/201, 207; 340/572.9, 568.1
See application file for complete search history.

(56) References Cited

U.S. PATENT DOCUMENTS

| | | | | |
|---|---|---|---|---|
| 7,961,100 | B2 * | 6/2011 | Wyatt, Jr. ..... | G08B 13/2434 340/568.1 |
| 9,437,088 | B2 * | 9/2016 | Phillips ..... | G08B 13/1409 |
| 2001/0035821 | A1 | 11/2001 | Ruhrig et al. | |
| 2004/0163430 | A1 | 8/2004 | Belden | |
| 2005/0017865 | A1 | 1/2005 | Belden | |

(Continued)

OTHER PUBLICATIONS

Patent Cooperation Treaty (PCT), International Search Report and Written Opinion for Application PCT/US2018/044099 filed Jul. 27, 2018, dated Sep. 26, 2018, International Searching Authority, US.

*Primary Examiner* — Eric Blount
(74) *Attorney, Agent, or Firm* — McDonald Hopkins LLC

(57) ABSTRACT

An example security device includes a tag and a sled. The tag may include a security element, a receiving recess, a locking channel adjacent to the receiving recess, and a slug biased towards a sled facing surface of the tag. The sled may include a base having a tab extending therefrom, an adhesive applied to a product facing surface of the base for applying the sled to a product, and a cavity in the base having an opening on a tag facing surface of the base.

18 Claims, 10 Drawing Sheets

(56) References Cited

U.S. PATENT DOCUMENTS

| | | | | |
|---|---|---|---|---|
| 2005/0237205 | A1 | 10/2005 | Gorst | |
| 2008/0156764 | A1 | 7/2008 | Necchi | |
| 2009/0152230 | A1 | 6/2009 | Belden | |
| 2010/0225485 | A1 | 9/2010 | Appalucci et al. | |
| 2010/0231388 | A1 | 9/2010 | Shute et al. | |
| 2013/0169440 | A1* | 7/2013 | Bruhwiler | G08B 13/00 340/572.9 |
| 2014/0253290 | A1 | 9/2014 | Yang | |
| 2015/0243145 | A1* | 8/2015 | Nguyen | E05B 73/0017 340/572.8 |
| 2015/0302711 | A1* | 10/2015 | Yang | G08B 13/2448 340/572.9 |

* cited by examiner

LOCKING SLED SECURITY DEVICE

CROSS-REFERENCE TO RELATED APPLICATION

This application is a 35 U.S.C. 371 national stage filing and claims priority to International Application No. PCT/US2018/044099 entitled "LOCKING SLED SECURITY DEVICE," filed on Jul. 27, 2018, which claims the benefit of U.S. Provisional Patent Application No. 62/537,995, entitled "LOCKING SLED SECURITY DEVICE," filed on Jul. 28, 2017, which is hereby incorporated by reference.

FIELD OF THE INVENTION

Example embodiments generally relate to security technology, and more particularly, relate to a security device for use in retail loss prevention.

BACKGROUND OF THE INVENTION

Product security devices are commonly used in a number of settings, including in retail loss prevention. In this regard, retail theft prevention systems, often referred to as electronic article surveillance (EAS) systems, use antennas located at the exits of a retail establishment to detect radio frequency (RF) signals emitted by a security device that is affixed to items, such as products for sale. A product security device may be affixed or locked to a product, and if the device is not removed at a point-of-sale during a sales transaction, the security device will be detected by the EAS system as the device, which is affixed to an product, leaves the store. An alarm may be triggered because the removal of the device from the retail establishment is likely to be associated with an attempted theft.

One example of a security device for a retail setting is a security tag for a bottle or other container having an opening. Some of these bottles contain expensive products such as wine and liquor, which in some locations are stored on a shelf and not behind a counter, thus becoming susceptible to shoplifting. It is a desire to protect these bottles by attaching a security device easily around the neck of the bottle which contains an EAS tag, which devices can be reused to reduce cost to the retail establishment, and which devices can be placed easily and rapidly on the neck of the bottle for display without occupying an appreciable amount of storage and display space. These devices also must be able to be mass produced relatively inexpensive to enable the retail establishment to purchase a number of the devices for use on their displayed products.

Although many of these devices perform satisfactory for their intended purpose, many of them are relatively expensive to manufacture due to the number of separate components that must be assembled. Also, many of these devices are relatively difficult to install and remove from the article of merchandise due to the particular type of latching or locking mechanism and mechanical actuated key for unlocking the security device and removing it from the article being protected. Moreover, some security devices may be prone to tampering Therefore, the need exists for a more efficient or improved security device. There is also a need for improved security devices for cylindrical-shaped objects, such as bottle necks. Additionally, it may be desirable to have security devices with an EAS tag in a concealed housing, and with an efficient, yet secure, unlocking mechanism.

SUMMARY OF THE INVENTION

The following presents a summary of this disclosure to provide a basic understanding of some aspects. This summary is intended to neither identify key or critical elements nor define any limitations of embodiments or claims. Furthermore, this summary may provide a simplified overview of some aspects that may be described in greater detail in other portions of this disclosure.

An example locking sled security device comprises a tag and a sled. The tag may comprise a first security element (e.g., EAS component), a receiving recess, and an engaging member (e.g., locking channel, threaded portion, friction fit portion, or the like) adjacent to the receiving recess, and a slug biased towards a sled facing surface of the tag. The sled may comprise a base having one or more sled engagement members that may engage with the engagement member of the tag (e.g., one or more tabs, thread portions, friction fit portions, etc.), an adhesive applied to a product facing surface of the base for affixing the sled to a product, and a cavity in the base having an opening on a tag facing surface of the base. The engaging member or the tag and the engaging member of the sled may comprise at least one of a channel and tab engagement, male and female threaded engagement, a hook and loop engagement, or a bayonet-type engagement. In at least one embodiment, the tag may be configured to receive a tab of the sled into a receiving recess of the tag. The tab may extend from the base of the sled. Upon receiving the tab of the sled into the receiving recess, the tag may be rotatable about an axis relative to the sled such that the tab travels from the receiving recess into a locking channel and into a locked position where a protrusion of the slug aligns with and engages the cavity of the sled. In a locked position, the tag may resist or otherwise be prevented from moving relative to the sled in an axial direction due to engagement between the tab and the locking channel, and the tag may be prevented from rotating relative to the sled due to engagement between the protrusion of the slug and the cavity of the sled.

The first security element may be configured to respond to an electromagnetic field with a radio frequency signal for detection by an alarming unit. In an embodiment, the security device may comprise a second security element. The second security element may operate at a different frequency than the first security element. For example, the second security element may be an RFID tag.

According to some example embodiments, the tab may include a beveled edge configured to engage a complementary beveled edge of the locking channel. According to some example embodiments, the example security device may comprise a second security element that operates at a different frequency than the first security element. Other example apparatuses are also provided.

In an embodiment, the security device may further comprise a security collar configured to be locked onto a product by the tag. The security collar may comprise a locking ring that forms an opening sized to receive the sled, a first anti-tampering wall extending upwards from the locking ring and operatively circumscribing the tag, and a second anti-tampering wall extending downwards from the locking ring. The security collar may be free to rotate relative to the tag, the sled, and the product in order to prevent the security collar from being used as leverage to improperly remove the security device. The security collar may further comprise fins in an interior lower cavity of the security collar to prevent the second anti-tampering wall from being pressed against the product to improperly remove the security device.

In an embodiment, the security device further comprises a detaching key operatively configured to permit movement of the slug and allow rotation of the tag from the locked position to an unlocked position.

The following description and the drawings disclose various illustrative aspects. Some improvements and novel aspects may be expressly identified, while others may be apparent from the description and drawings.

BRIEF DESCRIPTION OF THE DRAWINGS

The accompanying drawings illustrate various systems, apparatuses, devices and methods, in which like reference characters refer to like parts throughout.

Figure 1:
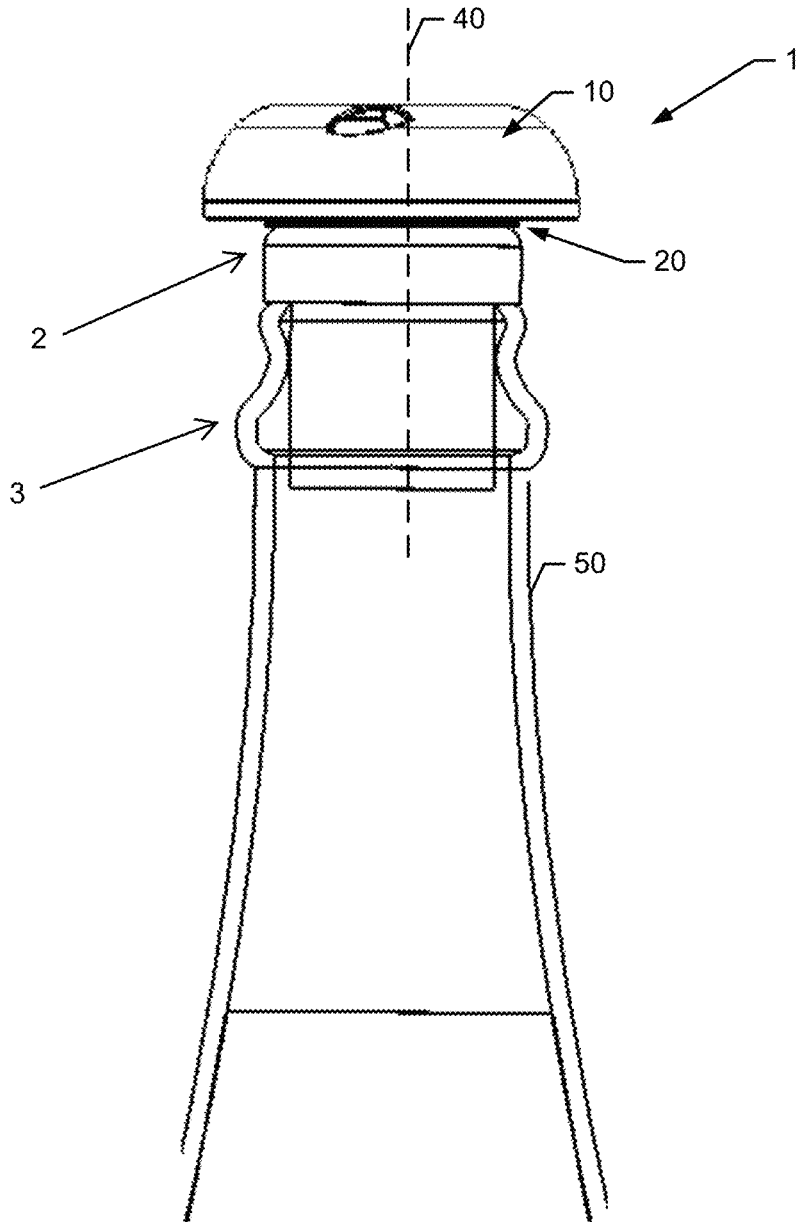
FIG. 1 shows an example locking sled security device affixed to a product m accordance with an example embodiment.

The invention may be embodied in several forms without departing from its spirit or essential characteristics. The scope of the invention is defined in the appended claims, rather than in the specific description preceding them. All embodiments that fall within the meaning and range of equivalency of the claims are therefore intended to be embraced by the claims.

DESCRIPTION OF PREFERRED EMBODIMENTS

Some example embodiments now will be described more fully hereinafter with reference to the accompanying drawings, in which some, but not all example embodiments are shown. Indeed, the examples described and pictured herein should not be construed as being limiting as to the scope, applicability, or configuration of the present disclosure. Rather, these example embodiments are provided so that this disclosure will satisfy applicable legal requirements. Like reference numerals refer to like elements throughout. It is to be understood that other embodiments may be utilized, and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggests otherwise.

The terms "tag," "chip," "EAS component," and the like may be used interchangeably, unless context suggests otherwise or warrants a particular distinction among such terms. It is further noted that tags may be chosen based on a frequency. Identification tags may comprise printable RF circuits, microchips, or the like. Tags can contain stored information, such as in a memory (e.g., read-only memory (ROM), random access memory (RAM), electrically erasable programmable read-only memory (EEPROM), or various other types of memory). In another aspect, a tag may be powered by electromagnetic induction from magnetic fields produced by a reader. For instance, an identification tag may include an antenna that utilizes induction between another antennae located within a reader to effectively form an air-core transformer. The antennae may comprise various materials, such as copper. While an air-core transformer is described, various other antennae formations may be utilized.

In an example, an EAS system may include a tag, a reader or emitter (such as at a store exit), and one or more antennae. For instance, the tag may include a loop antenna and the emitter may include another loop antenna. It is noted that the loop antennae may or may not be substantially similar to each other. The tag antenna and emitter antenna may be operatively coupled via an electromagnetic field. The coupling may form or represent an air-core coil or transformer. The emitter may generate an alternating current that may be received by the emitter antenna. The current may induce an electromagnetic field through the air or another carrier medium. The electromagnetic field may induce a current in the tag antenna. The received current may provide power to various components of the tag.

In various embodiments, a tag may include the antenna, a processor, and a memory device. The memory device may include various types of memory, such as electrically erasable programmable read-only memory (EEPROM) and the like. When the tag is powered (e.g., current induced by the electromagnetic field), the tag may generate a response that may be received by the emitter. As described herein, the identification tag may be a passive transponder that collects energy from interrogating radio waves and/or may include a local power source such as a battery. As such, an identification tag and a reader may be configured as a passive reader active tag (PRAT) system, active reader passive tag (ARPT) system, an active reader active tag (ARAT) system, or the like.

In another aspect, a tag may power various components or devices. For example, a tag may power a digital display and/or interface of a container. In embodiments, the identification tag may be configured to operate and/or communicate with a reader when within a threshold distance. For instance, an identification tag may communicate with a reader when the identification tag is less than or equal to j units from the reader, where j is a number and the unit is a unit of distance. In an example, the identification tag may operate when it is less than or about t centimeters from the reader, when it is less than or about one meter from the reader, etc. It is noted that the distance may be selected for a particular setting.

According to various example embodiments, an example locking sled security device is provided that includes a tag that securely attaches to a product via an attachment sled that is affixed to the product. The tag may include a wireless signal transmitting device that can be detected by an antenna of an electronic article surveillance (EAS) system located at, for example, an exit of a retail establishment to indicate that the item to which the security device is attached is being stolen or otherwise improperly removed from a location. The tag may be removable from the sled through the use of a prescribed detacher key (e.g., a magnetic key) at a point of sale in a retail establishment during a transaction to purchase the product.

More specifically, according to some example embodiments, an example security device may include tag and sled components. The sled may be affixed, via an adhesive, to a product to be protected, such as the cap of a bottle. The tag may then be removably locked to the sled to provide security to the product. To lock the tag to the sled, the tag may be configured to receive a tab of the sled into a receiving recess of the tag. Upon receiving the tab of the sled into the receiving recess of the tag, the tag may be rotated, by a user, relative to the sled such that the tab of the sled travels from the receiving recess of the tag into a locking channel of the tag. As the tab enters the locking channel, the tab of the sled may engage the locking channel, and more specifically a lower lip of the locking channel, thereby preventing the tag from being lifted away from the sled without rotating the tab back to the receiving recess. As rotation continues away from the receiving recess, the tab may travel within the channel into a locked position. In the locked position, a protrusion of a slug housed within the tag that is biased towards the sled may align with and engage a cavity in the sled. Due to the biasing, the protrusion of the slug may be forced into the cavity thereby preventing further rotational movement of the tag relative to the sled. In this configuration, the tag may not be removed from the sled, and therefore from the product, without the use of a detacher key.

To remove the tag from the sled, a detacher key with one or more magnets may be applied to the tag. Since the slug of the tag may be comprised of a ferrous material (e.g. steel), the slug may be urged against the bias force by the field of the magnet into a position where there protrusion of the slug no longer engages the cavity of the sled. With the protrusion of the slug removed from the cavity, the tag may now be rotated relative to the sled until the tab of the sled aligns with the receiving recess of the tag. Once in this position, the tag may be removed from the sled in the axial direction and put aside for reuse. The sled may remain with the product and leave the store with the purchased product.

At least one embodiment may comprise a security device comprising a tag comprising a first security element, a receiving recess, a locking channel adjacent to the receiving recess, and a slug biased towards a sled facing surface of the tag by a biasing member; and a sled comprising a base having a tab extending therefrom, an adhesive applied to a product facing surface of the base for applying the sled to a product, and a cavity in the base having an opening on a tag facing surface of the base. The tag is configured to receive the tab of the sled into the receiving recess of the tag. In an aspect, upon receiving the tab of the sled into the receiving recess, the tag is rotatable about an axis relative to the sled such that the tab travels from the receiving recess into the locking channel and into a locked position where a protrusion of the slug aligns with and engages the cavity of the sled. In another aspect, in the locked position the tag is prevented from moving relative to the sled in an axial direction due to engagement between the tab and the locking channel, and the tag is prevented from rotating relative to the sled due to engagement between the protrusion of the slug and the cavity of the sled.

It is noted that the first security element may be configured to respond to an electromagnetic field with a radio frequency signal for detection by an alarming unit. In some examples, the tab includes a beveled edge configured to engage a complementary beveled edge of a lip of the locking channel. Moreover, embodiments may comprise a second security element that operates a different frequency than the first security element. The second security element is an RFID tag. The security device may include a security collar that is configured to be locked on a product by the tag. The security collar may comprise a locking ring that forms an opening sized to receive the sled, a first anti-tampering wall extending upwards from the locking ring, and a second anti-tampering wall extending downwards from the locking ring. The security collar may be free to rotate relative to the tag, the sled, and the product, wherein the rotation prevents the security collar from being used as leverage to improperly remove the security device. In another example, the security collar further comprises fins in an interior lower cavity of the security collar, wherein the fins prevent the second anti-tampering wall from being pressed against the product to improperly remove the security device. Described biasing members may be a spring. The product to be secured may be a bottle. The receiving recess and the locking chambers of the tab may extend beyond the sled facing surface of the tag and interact with the tabs and the engagement surfaces of the sled. The receiving recess and the locking chambers of the tab form a recess within the sled facing surface of the tag and interact with the tabs and the engagement surfaces of the sled.

Also described is a security system including the security device as described herein and a detacher key. The detacher key may comprise a magnet and locating features, wherein the locating features are complementary to key locators on the tag and assist in the proper placement of the detacher key to the tag for detaching. The magnet of the detacher key interacts with the biasing member of the tag that biases the slug toward the sled facing surface of the tag, and removes the slug from the cavity of the sled; wherein upon removing the slug from the cavity, the tab thereafter is rotatable about the axis relative to the sled such that the tab travels from the locking channel into the receiving recess and into an unlocked position; and wherein the tag may be removed from the sled in an axial direction.

The tag may include one or more security elements that are configured to respond to a radio frequency (RF) field (or electromagnetic field) generated by antennas located at the exits (or entrances) of, for example, a retail store. The security element may respond to the RF field with an RF response signal. The security element may, according to some example embodiments, be an RF resonator (e.g., and LC circuit) configured to output a resonant signal of a certain frequency in response to the RF field. A receiver antenna of the alarm system may receive the signal provided by the security element and trigger an alarm to notify, for example, store personnel that a theft may be occurring because a product with a tag is nearing the exit.

In view of the foregoing, FIG. 1 shows an example locking sled security device 1 affixed to a product 50 in accordance with an example embodiment. The locking sled security device 1 comprises a tag 10 and a sled 20. Sled 20 may be affixed to a product 50 via an adhesive. In this example embodiment, the sled 20 is affixed to a cap 2 of a bottle 3 and the tag 10 is locked to the sled 20. When applying and removing the tag 10 from the sled 20, the tag 10 may rotate relative to the sled 20 about the axis 40, which may, for example, be a central axis of the sled 20.

Figure 2:
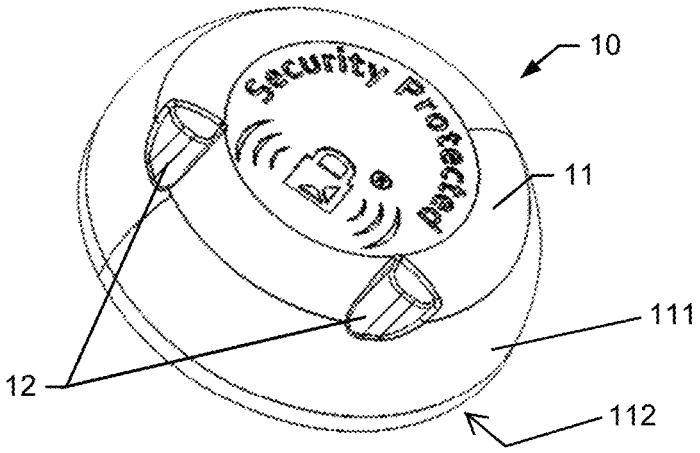
FIG. 2 shows a tag component of an example locking sled security device in accordance with an example embodiment.

FIG. 2 shows an exterior view of a top surface of the tag 10 according to some example embodiments. The tag 10 may include an upper cover 11 that, for example, has a shoulder 111. The shoulder 111 may comprise a rounded, convex, tapered, frustoconical, or other form factor about a periphery 112 of the cover 11. The cover 11 may include key locators 12 that assist a user with placement of a detacher key (not shown) to align the magnet of the key with the slug of the tag 10 to unlock the tag 10 from the sled 20, as described here as well as elsewhere in the specification. The key locators 12 may comprise indicia, physical formations (e.g., apertures, channels, etc.), or other components that may assist in alignment of a detacher key.

Figure 3:
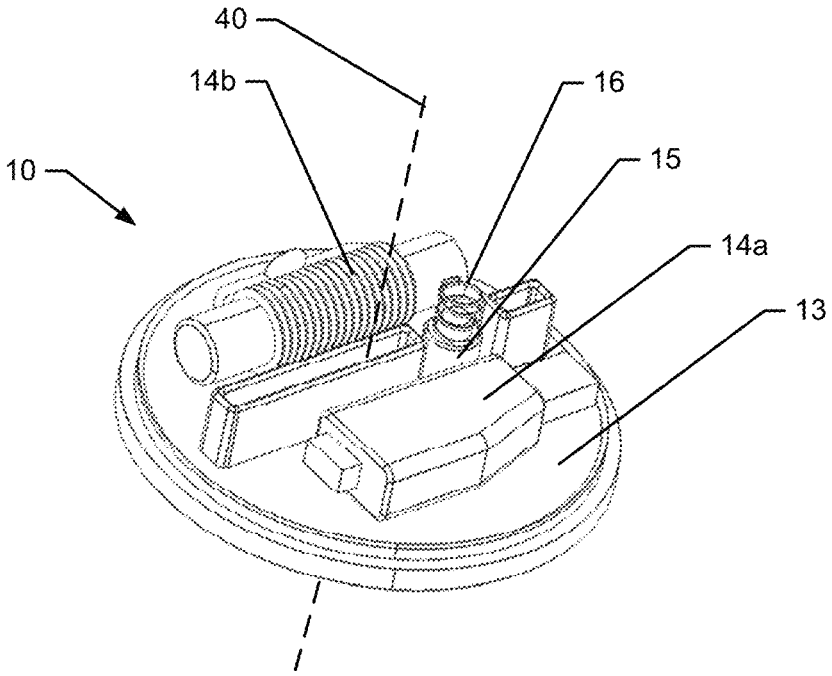
FIG. 3 shows another view of a tag component with a cover removed in accordance with an example embodiment.

FIG. 3 shows a view of the tag 10 with the upper cover 11 removed to show at least some of the internal components of the tag 10. In this regard, the tag 10 may include a base 13 to which at least some of the internal components may be affixed. According to some example embodiments, the cover 11 may be permanently snap-connected or welded to the base 13. In other embodiments, the cover 11 and the base 13 may be monolithically formed, adhered together with an adhesive, coupled together via fasteners, threaded together, or otherwise attached together.

The internal components of the tag 10 may include, for example, at least one security element (e.g., at least one of security elements 14*a* or 14*b*). In the example embodiment of tag 10, two security elements 14*a* and 14*b* are included. The tag 10 may be referred to as a dual-technology tag, because the tag may operate to send response signals in two different type of systems that operate at different frequencies, giving the tag 10 sales flexibility. In this regard, individually, the security elements may be one of a radio frequency resonator, an acousto-magnetic resonator, or an RFID tag. As a radio frequency resonator or acousto-magnetic device, the security elements may resonate in the presence of an electromagnetic field of a certain frequency and return a resonance signal that may be detected. In response to detecting the return resonance signal from the security elements, a remote alarm may be triggered to indicate that, for example, an individual is attempting to exit a retail establishment without having first had the tag 10 removed from a product (e.g., product 50) for sale by store personnel, which may be indicative of an attempted theft of the item.

Additionally or alternatively, one or more of the security elements may include an RFID tag. In this regard, the RFID tag may be configured to respond to an interrogation signal with a unique code indicative of the RFID tag. As such, the RFID tag may facilitate not only theft deterrence functions, but also inventory counting or tracking of the location of the security element within and environment that is appropriately equipped with tracking hardware.

In embodiments, the components of the tag 10 may include a biasing member 16 and a slug 15. According to some example embodiments, the biasing member 16 may be a magnet, a spring, or other biasing member that is disposed between the cover 11 and the slug 15 to urge the slug away from the cover 11 and towards the base 13 (and the sled facing surface) of the tag 10. The slug 15 may comprise a ferrous metal that is attracted to magnetic fields. The slug 15 may include a feature to interface with the biasing member 16, such as a protrusion, recess, or the like. In an aspect, the slug 15 may include a protrusion 30 that extends through an opening in the base 13 of the tag 10, when the detacher key with a magnet is not applied. Axis of rotation 40 is also shown in FIG. 3.

Figure 4:
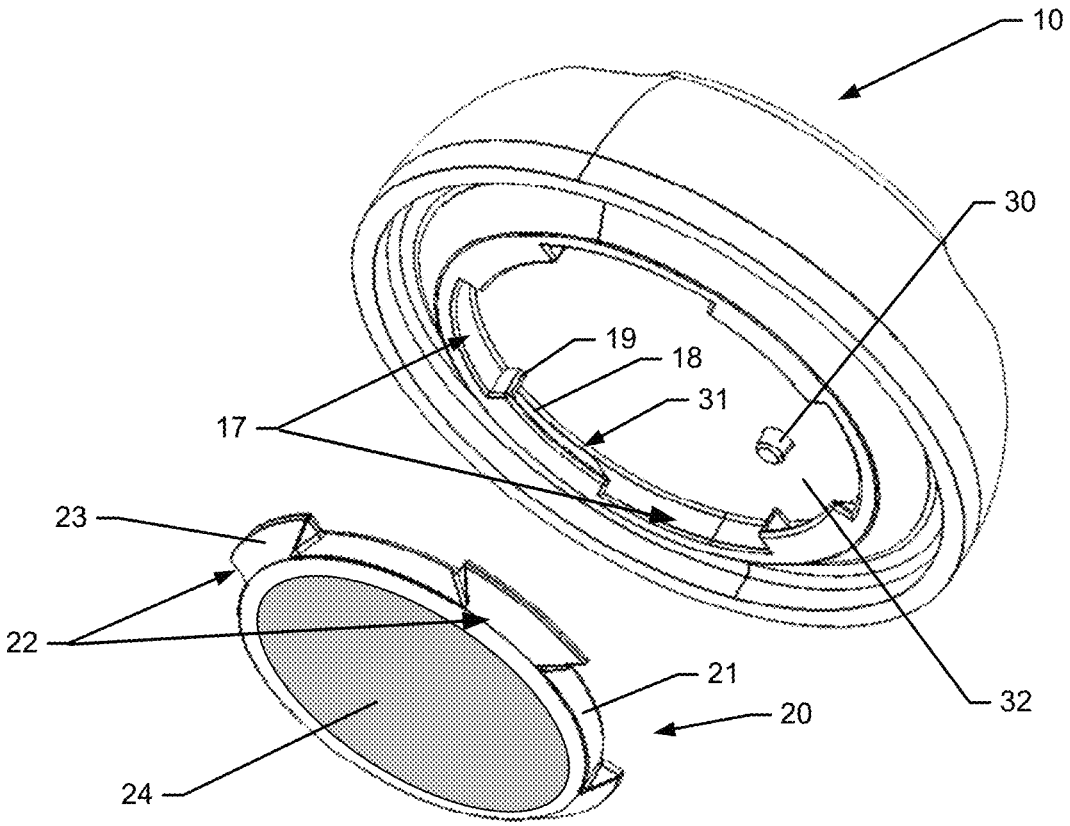
FIG. 4 shows a tag component and a sled component of an example locking sled security device in accordance with an example embodiment.

FIG. 4 shows the tag 10 and the sled 20 of the example locking sled security device 1 in accordance with an example embodiment. In this regard, the bottom or sled facing surface 32 of the tag 10 can be seen in FIG. 4. As can be seen, the protrusion 30 of the slug 15 may pass through an opening 5 in the base 13 of the tag 10. To interface with the sled 20 and facilitate locking to the sled 20, the tag 10 may include receiving recesses 17, locking channels 31, lower lips 18, and stops 19. The sled 20 may include a base 21, tabs 22 with respective engagement surfaces 23, and an adhesive 24. The adhesive 24 may be located on the product facing surface of the base 21 of the sled 20, and may be in the form of an adhesive pad with a removable layer that protects an adhesive surface until the user is prepared to apply the sled 20 to a product.

While it can be seen in FIG. 4 that four receiving recesses 17, four locking channels 31, four lower lips 18, and four stops 19 are included on the tag 10 for interaction with one of four respective tabs 22 of the sled 20, the following describes this interaction with respect to only one of each of these elements with the understanding that the same description applies to each of the four similarly. Further, while the tag 10 and sled 20 show four different complementary engagement features, it is noted that any number of engagement features may be utilized. It is further noted that the tag 10 and sled 20 may be secured or attached together via various types of cooperating engagement features. Such engagement features may include channels and protrusions, tongue and groove engagements, hook-style protrusions and corresponding latches, male and female threads, bayonet-type engagement features, or the like.

According to embodiments, after application of the sled 20 to a product, the tag 10 may be engaged and locked to the sled 20 via the corresponding engagement features of the tag 10 and sled 20, as well as the slug 30. In an exemplary embodiment, the tag 10 may be applied to the sled 20 such that tab 22 enters receiving recess 17. When the tab 22 is seated within receiving recess 17, the user may then rotate the tag 10 such that tab 22 enters locking channel 31 of the tag 10. Upon entering the locking channel 31, engagement surface 23 may be adjacent and above lower lip 18 thereby preventing the tag 10 from being lifted in the axial direction 40 away from the sled 20. According to some example embodiments, the engagement surface 23 of the tab 22 may be beveled and the lower lip 18 may have complimentary beveling to engage with the engagement surface 23. As the user continues to rotate the tag 10 relative to the sled 20, the tab 22 continues to travel in the locking channel 31 until the tab 22 reaches the stop 19. When the tab reaches the stop 19 or generally reaches the stop (e.g., within 0 to 1 mm of the stop 19), the tag 10 may be in the locked position.

Figure 5:
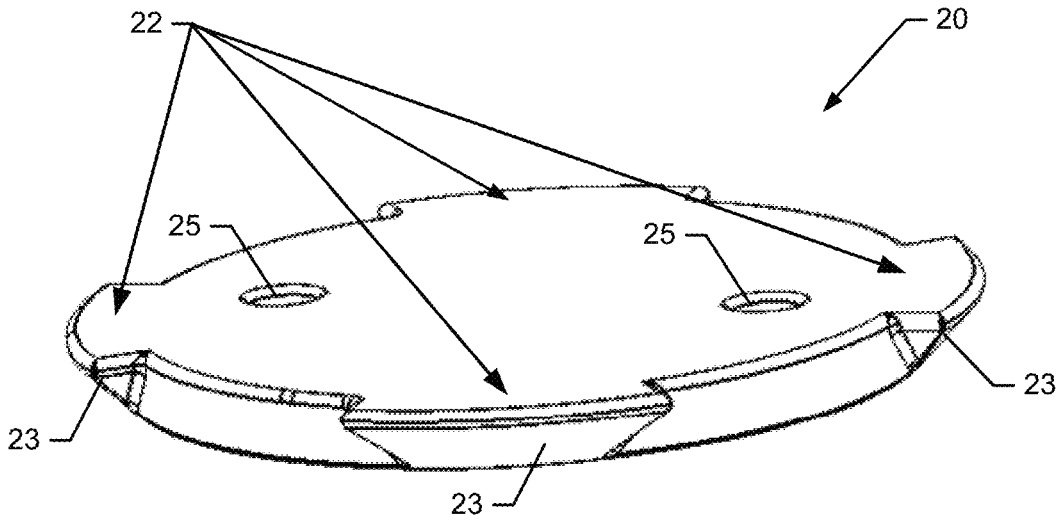
FIG. 5 shows a sled component in accordance with an example embodiment.

In the locked position, the protrusion 30 of the slug 15 may align with an opening in a cavity 25 of the sled 20, as shown in FIG. 5, which depicts cavities 25 on a tag facing surface of the base 21 and the sled 20. Upon alignment, the protrusion 30 of the slug 15 may pass into the cavity 25 of the sled 20, thereby preventing the tag 10 from rotating further, in either direction, relative to the sled 20. As such, in the locked position, the tag 10 may be prevented from being lifted away from the sled, for example, along the axis 40, due to the engagement between the engagement surface 23 of the tab 22 and the lower lip 18 of the tag 10 and be prevented from rotating relative the sled 20 due to the engagement between the protrusion 30 of the slug 15 and the cavity 25 of the sled 20. While illustrated as generally cylindrical, it is noted that the protrusion 30 and the cavity 25 may comprise other shapes, such as n-side prisms (where n is a number), polygonal shapes, or irregular shapes.

Figure 6:
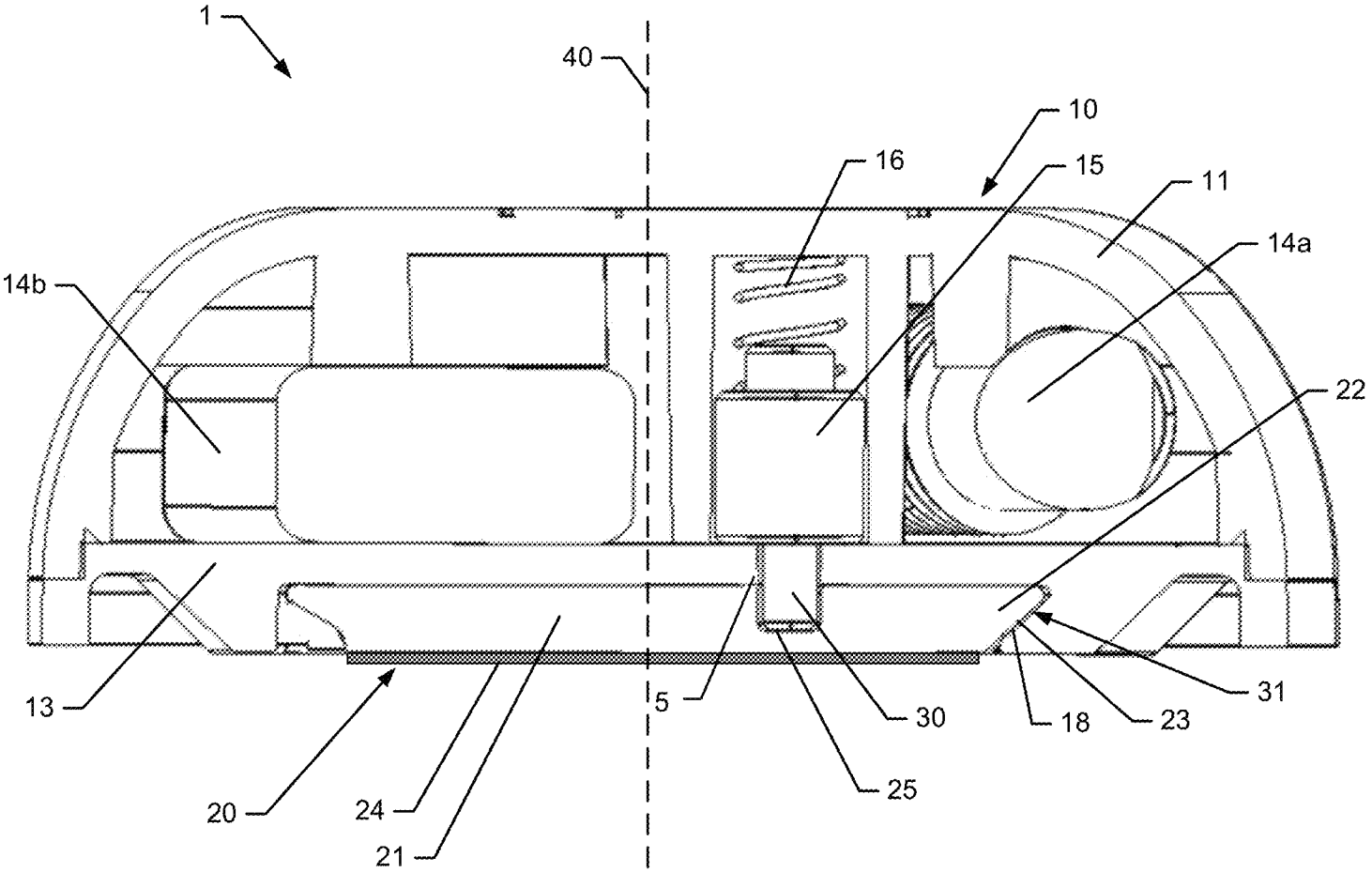
FIG. 6 shows a cross-section view of an example locking sled security device with component locked to a sled component in accordance with an example embodiment.

FIG. 6 shows a cross-section view of the locking sled security device 1 with the tag 10 locked to the sled 20 component in accordance with an example embodiment. As can be seen in FIG. 6, the engagement surface 23 of the tab 22 is engaged with the lower lip 18 of the locking channel 31. Further, the protrusion 30 of the slug 15 is disposed in the cavity 25 of the sled 20 because the tag 10 has been rotated into the locked position with the sled 20 where the protrusion 30 aligns with the cavity 25.

Figure 7:
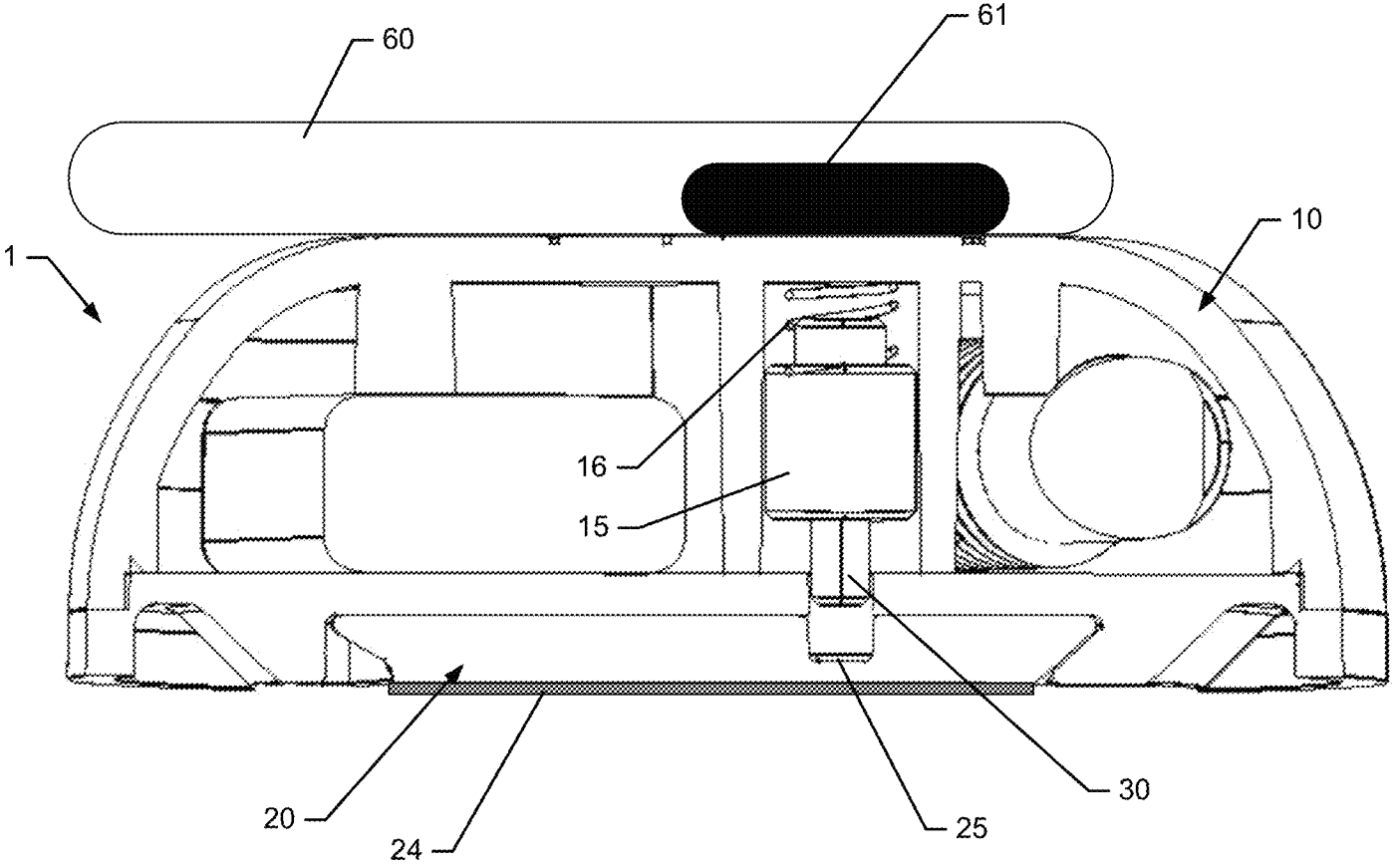
FIG. 7 shows a cross-section view of an example locking sled security device engaged with a detacher key n accordance with an example embodiment.

FIG. 7 shows a cross-section view of the locking sled security device 1 engaged with a detacher key 60 in accordance with an example embodiment. The detacher key 60 may include a magnet 61. The detacher key 60 may be placed in a prescribed position on the tag 10 as indicated by the key locators 12 of FIG. 2. The detacher key 60 may have complimentary locating features. In the prescribed position, the magnet 61 and its field align with the slug 15 to pull the slug 15 upwards, against the force of the biasing member 16, to remove the protrusion 30 from the cavity 25 in the sled 20. With the protrusion 30 of the slug 15 removed from the cavity 25, the tag 10 may now be rotated relative to the sled 20 until the tab 22 of the sled 20 aligns with the receiving recess 17 of the tag 10. Once in this position, the tag 10 may be removed from the sled 20 (e.g., lifted away from the sled 20 in the axial direction relative the axis 40) and put aside for reuse. The sled 20, which may be disposable, may remain with the product and leave, for example, the store with the purchased product.

Figure 8:
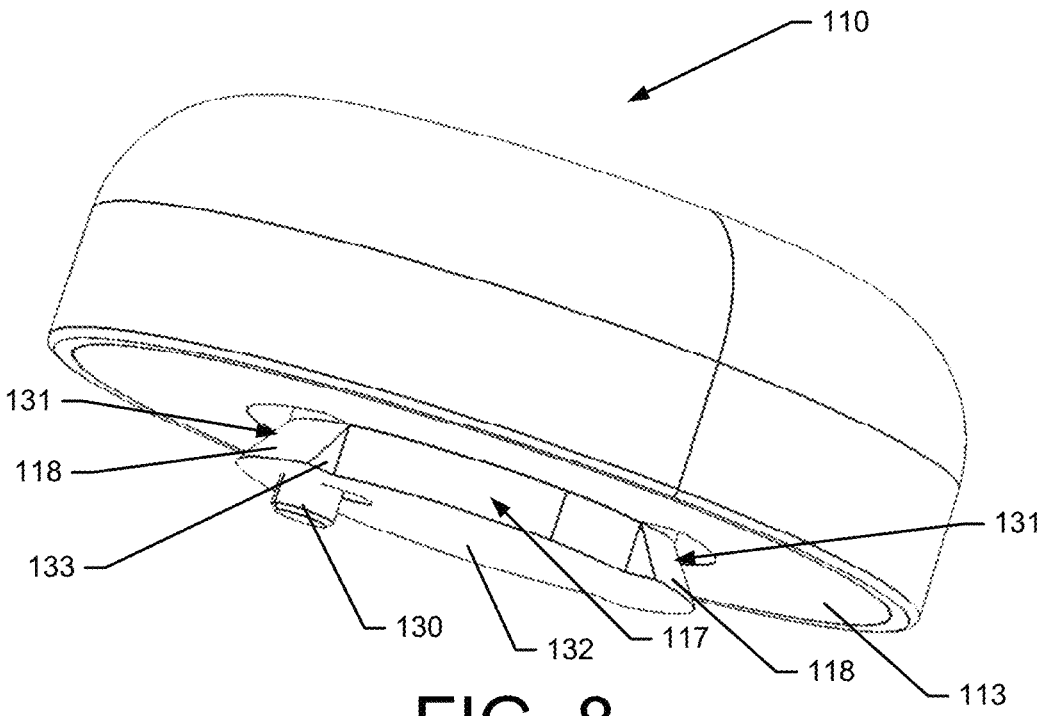
FIG. 8 shows another example tag with an alternative sled engagement interlace in accordance with an example embodiment.

FIG. 8 shows another example tag 110 according to some example embodiments. In this regard, the tag 110 may be the same or similar to the tag 10, with the exception of an alternative sled engaging interface. As shown in FIG. 8, the base 113 of the tag 110 and the sled facing surface 132 of tag 110 may include an extended portion of the base 113 that is configured to engage with a complementary sled 120, which may be similar to sled 120 with the exception of the tag engagement interface.

Figure 9:
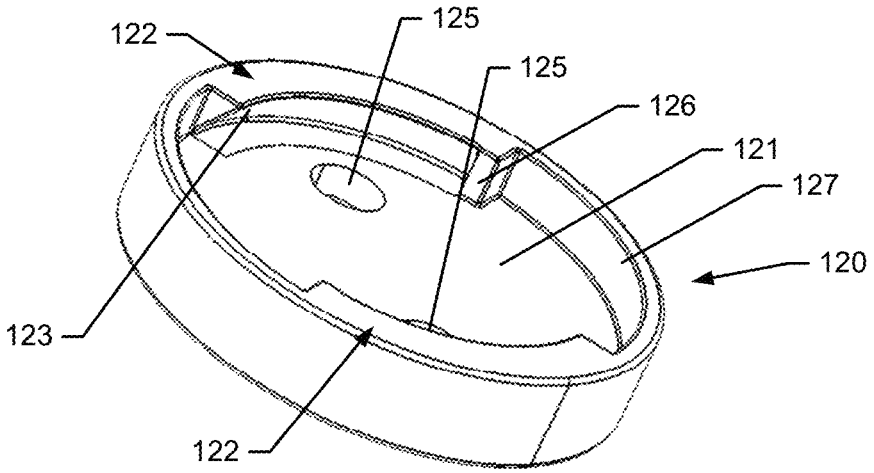
FIG. 9 shows an alternative example sled in accordance with an example embodiment.

Referring now to FIGS. 8 and 9, tag 110 and the sled 120 of the example locking sled security device 101 are provided. In this regard, the bottom surface or sled facing surface 132 of the tag 110 can be seen in FIG. 8. A protrusion 130 of a slug (similar to slug 15) may pass through an opening in the base 113 of the tag 110. To interface with the sled 120 and facilitate locking to the sled 120, the tag 110 may include receiving recesses 117, locking channels 131, and lower lips. The sled 120 may include a base 121, tabs 122 with respective engagement surfaces 123, cavities 125, stops 126, a and an adhesive (not shown). The adhesive may be located on the product facing surface of the base 121 of the sled 120, and may be in the form of an adhesive pad with a removable layer that protects an adhesive surface until the user is prepared to apply the sled 120 to a product. In contrast to the sled 20, sled 120 may include a circumferential ridge 127 that is part of the base 121, from which the tabs 122 extend.

While it can be seen in FIG. 8 that two receiving recesses 117, two locking channels 131, and two lower lips 118 are included on the tag 110 for interaction with one of two respective tabs 122 of the sled 120, the following describes this interaction with respect to only one of each of these elements with the understanding that the same description applies to each two similarly. Further, while the tag 110 and sled 120 show two different complementary engagement features, it is contemplated that any number of engagement features may be utilized.

Accordingly, after application of the sled 120 to a product, the tag 110 may be engaged and locked to the sled 120. In this regard, the tag 110 may be applied to the sled 120 such that tab 122 enters receiving recess 117. When the tab 122 is seated within receiving recess 117, the user may then rotate the tag 110 such that tab 122 enters locking channel 131 of the tag 110. Upon entering the locking channel 131, engagement surface 123 may be adjacent and above lower lip 118 thereby preventing the tag 110 from being lifted in the axial direction (referring to the axis of rotation) away from the sled 120. According to some example embodiments, the engagement surface 123 of the tab 122 may be beveled and the lower lip 118 may have complimentary beveling to engage with the engagement surface 123. As the user continues to rotate the tag 110 relative to the sled 120, the tab 122 continues to travel in the locking channel 131 until an edge 133 of the locking channel 131 reaches the stop 126 of the sled 120. When the edge 133 reaches the stop 119, the tag 110 may be in the locked position.

In the locked position, the protrusion 130 of the slug may align with an opening in a cavity 125 of the sled 120, as shown in FIG. 9, which depicts cavities 125 on a tag facing surface of the base 121 and the sled 120. Upon alignment, the protrusion 130 of the slug may pass into the cavity 125 of the sled 120, thereby preventing the tag 110 from rotating further, in either direction, relative to the sled 120. As such, in the locked position, the tag 110 may be prevented from being lifted away from the sled 120, for example, along the axis of rotation, due to the engagement between the engagement surface 123 of the tab 122 and the lower lip 118 of the tag 110 and be prevented from rotating relative the sled 120 due to the engagement between the protrusion 130 of the slug and the cavity 125 of the sled 120.

It is noted that the tabs 122 and the lips 118 may additionally or alternatively be referred to as channels 122 and tabs 118. In an aspect, this may represent a similar locking systems as shown in FIGS. 1-7 except where the channels are formed in or with the sled while tabs are formed in or with the tag. The labeling or nomenclature utilized to describe such engagement features is selected for simplicity of explanation throughout this disclosure. Accordingly, it is noted that different or other nomenclatures may be used to describe similar or the same engagement interfaces or features.

Figure 10:
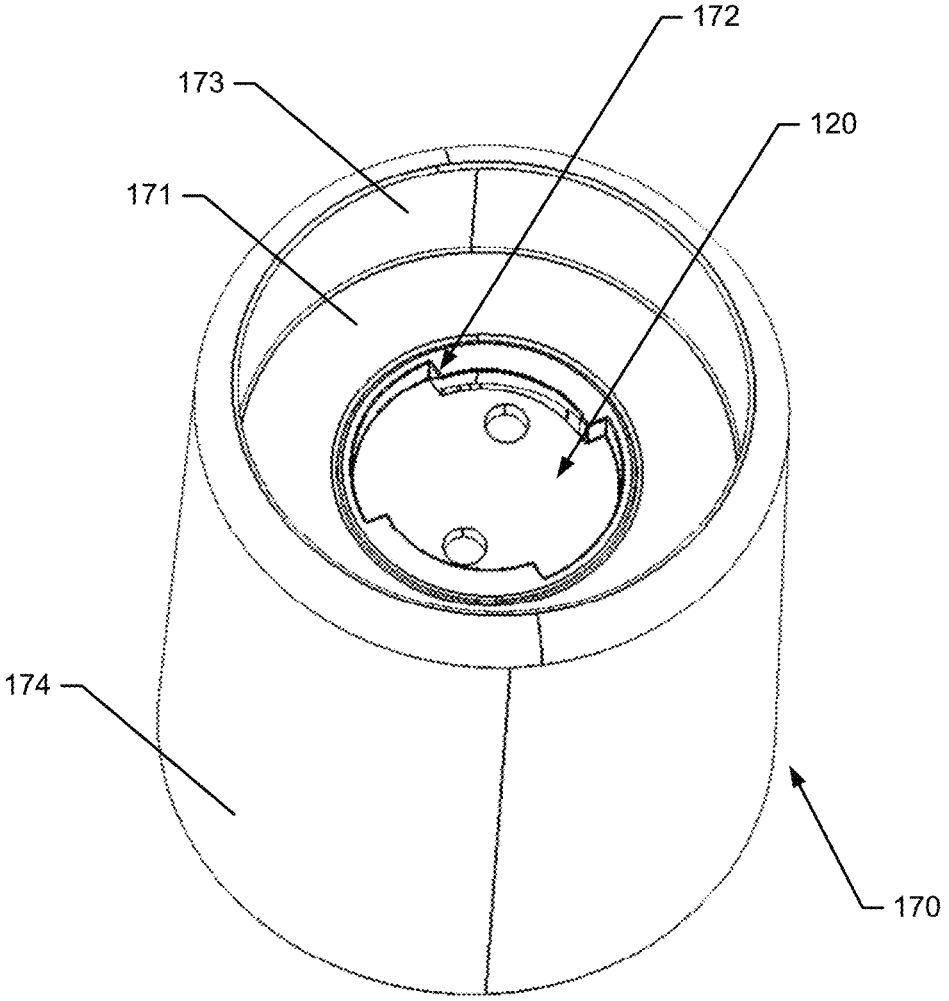
FIG. 10 shows an example sled and a security collar in accordance with an example embodiment.

FIG. 10 shows an example sled 120 and a security collar 170 in accordance with an example embodiment. The security collar 170 may be an optional accessory that can be used in conjunction with the tag 100 and the sled 120. The security collar 170 may be, for example, a cylindrical or partially conical tube having a locking ring 171 disposed in its interior. As can be seen in FIG. 10, the locking ring 171 may be a shelf that may extends around the interior of the security collar 170. The locking ring 171 may form an opening 172 that may be sized to receive the sled 120 within the opening 172. As such, if the sled 120 is affixed (e.g., via adhesive) to a bottle top, the security collar 170 may be placed on the bottle and around the sled 120 in preparation for the tag 110 to be locked to the sled 120, thereby also locking the security collar 170 in place with the sled 120 and the tag 110. In this regard, the base 113 may be wider than the sled 120 and therefore the outer portions of the base 113 may engage with the locking ring 171 to lock the security collar 170 to the bottle and the tag 110.

The security collar 170 may extend upwards from the locking ring 171 to form an anti-tamper wall 173. In this regard, when the tag 110 is locked to the security collar 170 and the sled 120, the anti-tamper wall 173 may prevent access to the tag-sled interface to avoid tampering with the tag 110 or the sled 120 in an effort to steal a product. Further, the security collar 170 may extend downward from the locking ring 171 to form an anti-tamper wall 174. In this regard, when the tag 110 is locked to the security collar 170 and the sled 120, the anti-tamper wall 174 may prevent access to the bottle cap to avoid tampering with or removal of the cap.

As mentioned above, after the sled 120 is affixed to a product and the security collar 170 is placed on the sled 120 such that the locking ring 171 surrounds the sled 120, the tag 110 may be locked to the sled 120. The tag 110 may be placed in the upper cavity of the security collar 170 and rotated to lock onto the sled 120. The tag 110, merely engages the security collar 170 at an interface between the base 113 and the locking ring 171. Due to a height of the sled 120 and the extended portion of the base 113, a gap between the product (e.g., bottle cap) and the base 113 of the tag 110 may be formed. The locking ring 171 of the security collar 170 may reside in the gap, which may be longer than the thickness of the locking ring. Accordingly, while the security collar 170 may be locked between the product and the tag 110, the security collar 170 may be free to rotate relative to the tag 110, the sled 120, and the product. This feature may operate as a security feature. Because the security collar 170 can rotate freely relative to the sled 120, the tag 110, and the product, the security collar 170 cannot be used as leverage to remove the sled 120 or the tag 110 from the product, or remove, for example, the cap of a bottle that the sled 120 is affixed to.

Figure 11:
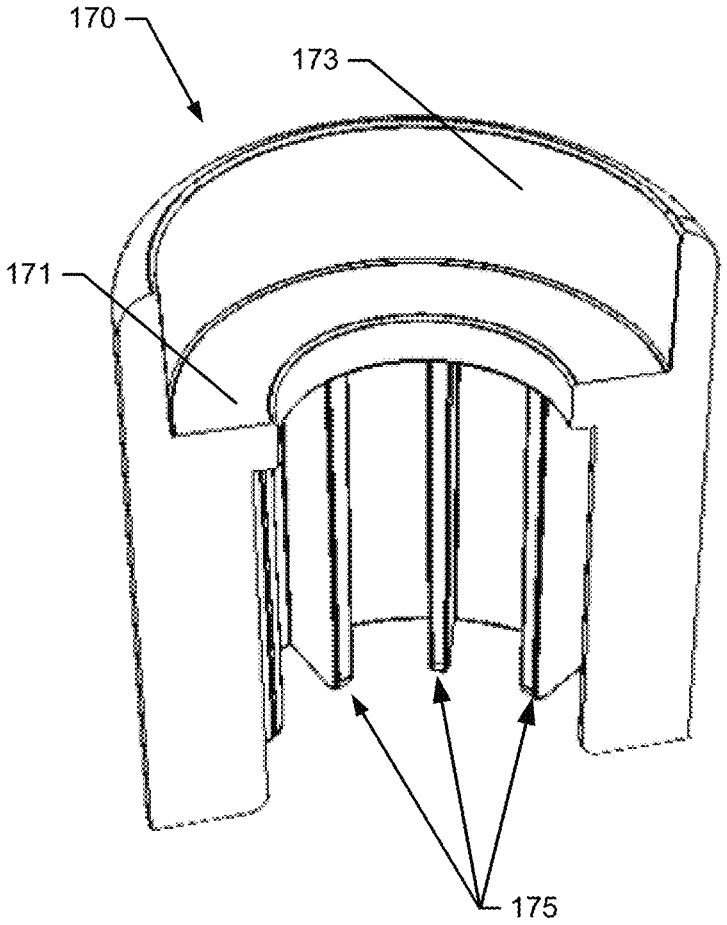
FIG. 11 shows a cross-sectional view of an example security collar in accordance with an example embodiment.

FIG. 11 shows a cross-sectional view of the security collar 170. In this view, fins 175 in the interior lower cavity (below the locking ring 171) of the security collar 170 can be seen. The fins 175 may be place around the internal circumference of the interior lower cavity of security collar 170. According to some example embodiments, the fins 175 may be spaced at regular intervals. The fins 175 may extend into the interior lower cavity. According to some example embodiments, the fins 175 may be configured to engage a surface of a product. In this regard, the presence of the fins 175 may prevent the anti-tamper wall 174 form being pressed against the exterior surface of a neck of a bottle to create a moment/force on the base 113 of tag 110 to pry the tag 110 away from the bottle cap. As such, the fins 175 may function as yet another security feature.

Figure 12:
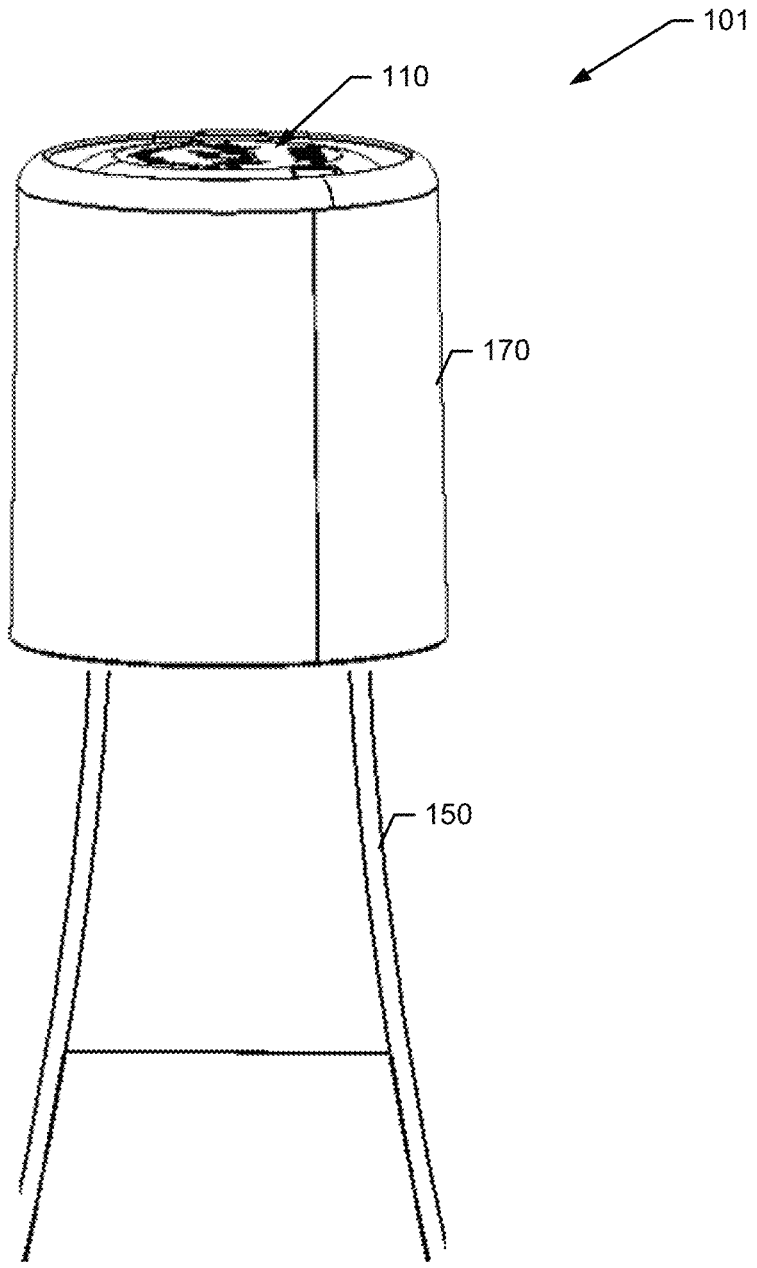
FIG. 12 shows an implementation of a security collar in accordance with an example embodiment.

FIG. 12 shows the security collar 170 installed on a bottle 150 in accordance with an example embodiment. The security device 101 comprising the tag 110, the sled 120, and the security collar 170 may be installed on the bottle 150 not only to protect the bottle 150 from theft by leaving the store, but to also protect against in-store tampering with the bottle. In the installed position, the security collar 170 may not be removed without first detaching the tag 110 from the sled 120 using a detacher key, as described with respect to FIG. 7. Further, in the installed position, the security collar 170 may not be removed in the upward direction due to the base 113 of the tag 110 being extended over the locking ring 171 to prevent movement in the upward direction. Further, in the installed position, the security collar 170 may not be removed in the downward direction due to tapered bottle 50. According to some example embodiments, the security collar 170 may also include internal fins that extend downward from the locking ring 171 to engage the bottle 150.

Many modifications and other embodiments according to those set forth herein will come to mind to one skilled in the art to which these embodiments pertain having the benefit of the teachings presented in the foregoing descriptions and the associated drawings. Therefore, it is to be understood that embodiments are not to be limited to the specific ones disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A security device comprising:

a tag comprising a first security element, a sled facing surface, a slug biased towards a sled facing surface, and an engagement feature; and a sled comprising:

a base comprising a sled engagement feature, a product facing surface, a tag facing surface, and a cavity comprising an opening on the tag facing surface; and an adhesive applied to the product facing surface for applying the sled to a product;

wherein the engagement feature and the sled engagement feature cooperate to secure the tag and sled together when the tag is operatively rotated about an axis of the sled to a locked position, and wherein the slug operatively extends through the opening when the engagement feature and the sled engagement feature are in the locked position, and wherein the security device further comprises a security collar configured to be locked on a product by the tag, the security collar comprises a locking ring that forms an opening sized to receive the sled, a first anti-tampering wall extending upwards from the locking ring and operatively circumscribing the tag, and a second anti-tampering wall extending downwards from the locking ring, wherein, the security collar may be free to rotate relative to the tag, the sled, and the product, wherein the rotation prevents the security collar from being used as leverage to improperly remove the security device.

2. The security device of claim 1, wherein the engagement feature and the sled engagement feature comprise at least one of a channel and tab engagement, male and female threaded engagement, a hook and loop engagement, or a bayonet-type engagement.

3. The security device of claim 1, wherein the engagement feature comprises at least one receiving recess and at least one locking channel.

4. The security device of claim 3, wherein the sled engagement feature comprises at least one tab extending from the base.

5. The security device of claim 4, wherein the at least one receiving recess is configured to receive the at least one tab, and wherein, upon receiving the at least one tab, the tag is rotatable about the axis such that the at least one tab travels from the at least one receiving recess into the at least one locking channel.

6. The security device of claim 5, wherein in the locked position the tag is prevented from moving relative to the sled in an axial direction due to engagement between the at least one tab and the at least one locking channel, and the tag is prevented from rotating relative to the sled due to engagement between the slug and the cavity.

7. The security device of claim 4, wherein the at least one tab includes a beveled edge and wherein the at least one locking channel includes complementary beveled edge configured to engage the beveled edge of the at least one tab.

8. The security device of claim 1, wherein the first security element is configured to respond to an electromagnetic field with a radio frequency signal for detection by an alarming unit.

9. The security device of claim 1, further comprising a second security element that operates at a different frequency than the first security element.

10. The security device of claim 9, wherein the second security element is an RFID tag.

11. The security device of claim 1, wherein the security collar further comprises fins in an interior lower cavity of the security collar, wherein the fins prevent the second anti-tampering wall from being pressed against the product to improperly remove the security device.

12. A security device comprising:

a tag comprising a first security element, a sled facing surface, a slug biased towards a sled facing surface, and an engagement feature; and a sled comprising:

a base comprising a sled engagement feature, a product facing surface, a tag facing surface, and a cavity comprising an opening on the tag facing surface; and an adhesive applied to the product facing surface for applying the sled to a product; and a security collar comprising a locking ring that forms an opening sized to receive the sled, a first anti-tampering wall extending upwards from the locking ring and operatively circumscribing the tag, and a second anti-tampering wall extending downwards from the locking ring, and wherein the security collar may be free to rotate relative to the tag, the sled, and the product, wherein the rotation prevents the security collar from being used as leverage to improperly remove the security device, wherein the engagement feature and the sled engagement feature cooperate to secure the tag and sled together when the tag is operatively rotated about an axis of the sled to a locked position, and wherein the slug operatively extends through the opening when the engagement feature and the sled engagement feature are in the locked position.

13. The security device of claim 12, wherein the engagement feature includes at least one locking channel and at least one recess, and wherein the sled engagement feature includes at least one tab sized to be received by the recess.

14. The security device of claim 12, wherein the sled engagement feature includes at least one locking channel and at least one recess, and wherein the engagement feature includes at least one tab sized to be received by the recess.

15. A security device comprising, a tag comprising a first security element, a sled facing surface, a slug biased towards a sled facing surface, and at least one locking channel; and a sled comprising:

a base comprising a product facing surface, a tag facing surface, a cavity comprising an opening on the tag facing surface, and at least one tab operatively received by the at least one locking channel when the tag is operatively rotated about an axis of the sled to a locked position, and wherein the security device further comprises a security collar configured to be locked on a product by the tag, the security collar comprises a locking ring that forms an opening sized to receive the sled, a first anti-tampering wall extending upwards from the locking ring and operatively circumscribing the tag, and a second anti-tampering wall extending downwards from the locking ring, wherein, the security collar may be free to rotate relative to the tag, the sled, and the product, wherein the rotation prevents the security collar from being used as leverage to improperly remove the security device, wherein the slug operatively extends through the opening when the at least one locking channel and the at least one tab are in the locked position.

16. The security device of claim 15, further comprising a detaching key operatively configured to permit movement of the slug and allow rotation of the tag from the locked position to an unlocked position.

17. A security device comprising:

a tag comprising a first security element, a sled facing surface, a slug biased towards a sled facing surface, and an engagement feature the engagement feature comprising at least one receiving recess and at least one locking channel; and a sled comprising:

a base comprising a sled engagement feature the engagement feature comprising at least one receiving recess, at least one locking channel, and at least one tab extending from the base; a product facing surface, a tag facing surface, and a cavity comprising an opening on the tag facing surface; and an adhesive applied to the product facing surface for applying the sled to a product;

wherein the engagement feature and the sled engagement feature cooperate to secure the tag and sled together when the tag is operatively rotated about an axis of the sled to a locked position, wherein the sled engagement feature comprises at least one tab extending from the base;

wherein the slug operatively extends through the opening when the engagement feature and the sled engagement feature are in the locked position, wherein the at least one receiving recess is configured to receive the at least one tab, and wherein, upon receiving the at least one tab, the tag is rotatable about the axis such that the at least one tab travels from the at least one receiving recess into the at least one locking channel, and wherein in the locked position the tag is prevented from moving relative to the sled in an axial direction due to engagement between the at least one tab and the at least one locking channel, and the tag is prevented from rotating relative to the sled due to engagement between the slug and the cavity.

18. A security device comprising:

a tag comprising a first security element, a sled facing surface, a slug biased towards a sled facing surface, and an engagement feature, the engagement feature comprises at least one receiving recess and at least one locking channel; and a sled comprising:

a base comprising a sled engagement feature, a product facing surface, a tag facing surface, and a cavity comprising an opening on the tag facing surface; and an adhesive applied to the product facing surface for applying the sled to a product;

wherein the engagement feature and the sled engagement feature cooperate to secure the tag and sled together when the tag is operatively rotated about an axis of the sled to a locked position, the sled engagement feature comprises at least one tab extending from the base, and the at least one tab includes a beveled edge and wherein the at least one locking channel includes complementary beveled edge configured to engage the beveled edge of the at least one tab, and wherein the slug operatively extends through the opening when the engagement feature and the sled engagement feature are in the locked position.

* * * * *